US009026396B2

(12) United States Patent
Evans et al.

(10) Patent No.: US 9,026,396 B2
(45) **Date of Patent: *May 5, 2015**

(54) IMPACT SENSING DEVICE AND HELMET INCORPORATING THE SAME

(75) Inventors: Jeffrey M. Evans, Omaha, NE (US); Christopher W. Circo, Omaha, NE (US)

(73) Assignee: Battle Sports Sicence, LLC, Omaha, NE (US)

( * ) Notice: Subject to any disclaimer, the term of this patent is extended or adjusted under 35 U.S.C. 154(b) by 519 days.

This patent is subject to a terminal disclaimer.

(21) Appl. No.: 13/303,978

(22) Filed: Nov. 23, 2011

(65) Prior Publication Data

US 2012/0124720 A1 May 24, 2012

Related U.S. Application Data

(60) Provisional application No. 61/416,416, filed on Nov. 23, 2010, provisional application No. 61/512,781, filed on Jul. 28, 2011.

(51) Int. Cl.

| | |
|---|---|
| ***G01P 15/00*** | (2006.01) |
| ***A63B 71/10*** | (2006.01) |
| ***G08B 21/00*** | (2006.01) |
| ***A42B 3/04*** | (2006.01) |

(52) U.S. Cl.

CPC ..... *A42B 3/046* (2013.01)

(58) Field of Classification Search

CPC ..... A42B 3/08; A42B 3/00; A42B 3/04; A42B 3/0433; A42B 3/0453; A42B 3/06; A42B 3/067; A42B 3/205; A63B 2220/40; A63B 2220/53; A63B 71/10; A63B 2220/833; A63B 2243/007; A63B 2243/0025; A63B 71/0054; G01P 15/0891; G01P 1/127; G01P 3/00

USPC ..... 702/141, 33, 41–43, 127, 138–139, 702/189; 2/6.6, 9, 206, 209.13, 410, 422, 2/425; 33/511–512; 73/1.37, 488, 73/491–492, 499, 510; 340/3.1, 3.3, 340/3.31–3.32, 539.12, 573.1, 665, 669; 600/587, 595

See application file for complete search history.

(56) References Cited

U.S. PATENT DOCUMENTS

| | | | |
|---|---|---|---|
| 5,546,609 | A | 8/1996 | Rush, III |
| 5,685,020 | A | 11/1997 | Powell et al. |
| 7,526,389 | B2 | 4/2009 | Greenwald et al. |

(Continued)

OTHER PUBLICATIONS

International Search Report and Written Opinion mailed Jun. 22, 2012 for Int. Appl. No. PCT/US2011/062095.

*Primary Examiner* — Toan Le

(74) *Attorney, Agent, or Firm* — Perkins Coie LLP

(57) ABSTRACT

An impact sensing device including a plurality of accelerometers orthogonally oriented with respect to each other and attachable at a body location, each capable of producing a signal indicative of an impact. An integrated circuit is configured to determine the magnitude and direction of the impact based on the signals and operative to activate an indicator when the magnitude exceeds a selected threshold based on the direction of the impact. A head injury coefficient is determined based on the magnitude and a duration of the impact, and the threshold level of acceleration is expressed in terms of a head injury coefficient value. The head injury coefficient value is determined by empirically correlating a head injury coefficient measured at the body location and a head injury coefficient measured at the center of mass of a human head resulting from an impact.

15 Claims, 19 Drawing Sheets

(56) References Cited

U.S. PATENT DOCUMENTS

| | | | | |
|---|---|---|---|---|
| 8,466,794 | B2 * | 6/2013 | Mack et al. | 340/573.1 |
| 2005/0177929 | A1 | 8/2005 | Greenwald et al. | |
| 2007/0089480 | A1 | 4/2007 | Beck | |
| 2009/0307827 | A1 | 12/2009 | Aspray | |
| 2011/0181419 | A1 | 7/2011 | Mack et al. | |
| 2013/0074248 | A1 * | 3/2013 | Evans et al. | 2/421 |

* cited by examiner

| Mainboard PCA | Quant | Description | Pkg | | Mfg | Mfg P/N |
|---|---|---|---|---|---|---|
| A1,A2 | 2 | ADXL193 | ADXL193 | | Analog Devices | AD22282-A |
| B1 | 1 | Button switch | EVQ-Q2 | | Panasonic | EVQ-Q2203W |
| C1, C9, C10, C12, C13 | 5 | 0.1uF | CAP_CERAMIC402 | 6.3V | AVX | 04026C104KAT2A |
| C2 | 1 | 4.7uF | CAP_CERAMIC805 | | AVX | 0805ZD475KAT2A |
| C3 | 1 | 10uF | CAP_CERAMIC805 | | AVX | 0805ZD106KAT2A |
| C4 | 1 | 0.01uF | CAP_CERAMIC603 | | AVX | 0603ZC103KAT2A |
| C5 | 1 | 18pF | CAP_CERAMIC603 | | AVX | 06033U180JAT2A |
| C6 | 1 | 18pF | CAP_CERAMIC603 | | AVX | 06033U180JAT2A |
| C7 | 1 | 10uF | CAP_CERAMIC805 | | AVX | 0805ZD106KAT2A |
| C8 | 1 | 1.5nF | CAP_CERAMIC402 | | AVX | 04025C152JAT2A |
| C11 | 1 | 150pf | CAP_CERAMIC402 | | AVX | 0402ZC151KAT2A |
| COIL | 1 | COIL-DO1608C | COIL-DO1608C | | CoilCraft | DO1608C-472 |
| D1 | 1 | Schottkey Diode | SOD-123 | | MOTOROLA | MBR0520L |
| D2, D3, D4, D5, D6, D7, D8 | 7 | Switching Diode | SOD-523 | | On-Semi | BAS16XV2T1G |
| J1 | 1 | Power | 2 pin straight | | CradConn | BB02-HC021-KB1-603000-6T |
| J2 | 1 | SWD | 4 pin straight | | CradConn | BB02-HC041-KB1-603000-6T |
| JP1, JP2 | 2 | mates daughter board conn | holes | | N/A | N/A |
| LED1 | 1 | Cree CLV6A-FKB | LED_RGB_PLCC6 | | CREE | CLV6A-FKB-CK1P1G1BB7R3R3 |
| Q1, Q4, Q5, Q6, Q7 | 5 | PMBT2222A | TRANSISTOR_NPN | | NXP | PMBT2222A,215 |
| Q2 | 1 | PMV65XP | MOSFET-P | | NXP | PMV65XP,215 |
| Q3 | 1 | MJD210_PNP | MJD210_PNP | | ON Semiconductor | MJD210T4G |
| R1 | 1 | 274 | RESISTOR0402 | 1/16W | Vishay/Dale | CRCW0402274RFKED |
| R2, R10, R12, R14 | 4 | 10K | RESISTOR0402 | | Vishay/Dale | CRCW040210K0JNED |
| R3 | 1 | 39 | RESISTOR0402 | | Vishay/Dale | CRCW040239R0JNED |
| R4, R6, R8 | 3 | 7.68k | RESISTOR0402 | | Vishay/Dale | CRCW04027K68FKED |
| R5, R7, R9 | 3 | 15k | RESISTOR0402 | | Vishay/Dale | CRCW040215K0FKED |
| R11, R13 | 2 | 51 | RESISTOR0402 | | Vishay/Dale | CRCW040251R0JNED |
| R15 | 1 | 110 | RESISTOR0402 | | Vishay/Dale | CRCW0402110RJNED |
| R16, R18, R22, R23 | 4 | 1M | RESISTOR0402 | | Vishay/Dale | CRCW04021M00JNED |
| R17 | 1 | 4.7M | RESISTOR0402 | | Vishay/Dale | CRCW04024M70JNED |
| R19 | 1 | 2.74k | RESISTOR0402 | | Vishay/Dale | CRCW04022K74FKED |
| R20 | 1 | 604k | RESISTOR0402 | | Vishay/Dale | CRCW0402604KFKED |
| R21 | 1 | 1.82M | RESISTOR0402 | | Vishay/Dale | CRCW04021M82FKED |
| U1 | 1 | SN74LVC1G79 | SC-88A | | TI | SN74LVC1G79DCKR |
| U2 | 1 | LTC4080 | DFN_16 | | Linear Technology | LTC4080EDHC#PBF |
| U3 | 1 | LTC3429 | SOT23-6 | | Linear Technology | LTC3429ES6#TRMPBF |
| U4 | 1 | LT1761 | SOT23-5 | | Linear Technology | LT1761ES5-3.3#TRMPBF |
| U5 | 1 | LPC_1342_HVQFN33 | HVQFN | | NXP | LPC_1342_HVQFN33 |
| U6 | 1 | MCP130T-315I/TT | SOT23-R | | Microchip Tech | MCP130T-315I/TT |
| Y1 | 1 | 12 MHz | CRYSTAL 3.2x2.5 | | NDK | NX3225SA-12.000000MHZ |

FIG.18

| Daughter board PCA | Quantity | Description | Eagle Component | pkg | mfg | mfg p/n | |
|---|---|---|---|---|---|---|---|
| C1 | 1 | 10nF 500V | CAP0805-CAP | 805 | Johanson Dielectrics | 501R15W103KV4E | |
| R1 | 1 | 1M | RESISTOR0402 | 402 | Vishay/Dale | CRCW04021M00JNED | |
| U1 | 1 | ADXL193 | ADXL193 | ADXL193 | Analog Devices | AD22282-A | |
| U2 | 1 | PRTR5V0U2X | PRTR5V0U2X | SOT143 | NXP | PRTR5V0U2X,215 | |
| X1 | 1 | USB-MICROB | USB-MICRO B | USB-MICRO I | Hirose Electric Co Lt | ZX62-B-5PA(11) | |
| J1, J2 | 2 | main board connector | 4 pin smd right angle conn | | GradConn | BB02-HH041-K06-025000 | 4 pins, pin length 2.5mm |

FIG.19

IMPACT SENSING DEVICE AND HELMET INCORPORATING THE SAME

CROSS REFERENCE TO RELATED APPLICATIONS

This application claims the benefit of U.S. Provisional Application No. 61/416,416, filed Nov. 23, 2010 and U.S. Provisional Application No. 61/512,781, filed Jul. 28, 2011, the disclosures of which are hereby incorporated by reference in their entirety.

BACKGROUND

Concussion, or mild traumatic brain injury (MTBI), is the most common type of traumatic brain injury. Sports-related concussions have increased over the years. This may be related to the increased physical stature of athletes and the intensity of contact sports over time. Frequently defined as a head injury with a temporary loss of brain function, concussion can cause a variety of physical, cognitive, and emotional symptoms.

The human body generally is built to protect the brain from traumatic injury. Cerebrospinal fluid surrounds the brain beneath the skull. The skull provides the hardened exterior protection, while the cerebrospinal fluid provides a hydraulic "cushion" that protects the brain from light trauma. However, severe impacts or forces associated with rapid acceleration and deceleration may not be absorbed by this cushion. As they are understood, however, concussions are likely caused by impact forces, in which the head strikes or is struck by an object. In other instances, concussion may be caused by impulsive forces, in which the head moves without itself being subject to blunt trauma, such as in the case of severe whiplash.

Concussive forces may engage an individual's head in a manner that causes linear, rotational, or angular movement of the brain. In rotational movement, the head turns around its center of gravity, and in angular movement it turns on an axis not through its center of gravity. Concussions and their proximate causation remain the center of study and debate. However, it is generally accepted that the threshold amount of blunt force for concussion is approximately 70-75 g (g indicates the force of gravity). Impacts to the individual's head of this magnitude and greater are thought to adversely affect the midbrain and diencephalon. The forces from the injury are believed to disrupt the normal cellular activities in the reticular activating system located in these areas. Such disruption may produce loss of consciousness, which often occurs in concussion injuries.

The prior art has produced a wide array of protective equipment, such as helmets, mouth guards, and other headgear in an attempt to reduce the number of sports-related concussions. However, diagnosis, especially during a sporting event, remains undeveloped in the art. Typically, concussion diagnosis is based on physical and neurological exams, duration of unconsciousness and post-traumatic amnesia. Various neuropsychological tests are used to measure cognitive function. However, the tests may be administered hours, days, or weeks after the injury to determine whether there is a trend in the patient's condition. Frequently, athletes and coaches are too focused on the sporting event and not on the athlete's current or long-term health. Accordingly, basic initial symptoms are overlooked or ignored by some athletes and coaches in the "heat of battle." Unfortunately, the prior art has, heretofore, not provided safe and reliable mechanisms for detecting the likelihood of concussion-related injury.

SUMMARY

This Summary is provided to introduce a selection of concepts in a simplified form that are further described below in the Detailed Description. This Summary, and the foregoing Background, are not intended to identify key aspects or essential aspects of the claimed subject matter. Moreover, this Summary is not intended for use as an aid in determining the scope of claimed subject matter.

Disclosed herein is an impact sensing device comprising an accelerometer capable of producing a signal that is indicative of acceleration and an indicator, such as a light emitting diode (LED), that has an active state and an inactive state. The impact sensing device also includes an integrated circuit that is operative to receive the signal from the accelerometer and operative to cause the indicator to be in the active state if the signal reaches a selected threshold level.

In an embodiment, the impact sensing device includes at least one accelerometer capable of producing a signal indicative of an impact and an integrated circuit configured to receive the signal and activate an indicator, such as a visual indicator, when the signal exceeds a selected threshold level. The impact sensing device may include an item attachable to the body of a person, such as a head band, helmet, or chin guard, for example. The visual indicator may be in the form of a multicolor light emitting diode.

In an embodiment, the impact sensing device is in the form of a chin guard having a shell sized and configured to receive a person's chin. The accelerometer and integrated circuit may be contained in the shell and disposed between the shell and a soft inner cuff disposed in the shell. The chin guard may also include a strap that is connectable to a helmet. In an embodiment, the strap includes a button snap attached to the strap and connectable to a helmet, wherein the button snap includes contacts operative to activate the impact sensing device when connected to the helmet.

In another embodiment, the impact sensing device includes a plurality of accelerometers orthogonally oriented with respect to each other, each capable of producing a signal indicative of an impact. In this case, the integrated circuit is configured to determine the magnitude and direction of the impact and activate the indicator when the magnitude exceeds a selected threshold based on the direction of the impact.

Also contemplated is a method for indicating when a user has received a potentially traumatic impact. In an embodiment the method comprises establishing a threshold level of acceleration for at least one direction of interest and attaching a plurality of accelerometers to a user at a body location. Each accelerometer is orthogonally oriented with respect to each other and each capable of producing a signal indicative of an impact. The magnitude and direction of the impact is determined based on the signals from the accelerometers. An indicator is then activated if the magnitude exceeds the threshold level of acceleration. The method may further include establishing a first threshold level of acceleration for a first direction and a second threshold of acceleration for a second direction, wherein the first threshold level is greater than the second threshold level. In an embodiment, the first direction corresponds to the front of the user's head and the second direction corresponds to a side of the user's head.

The method may include determining a head injury coefficient based on the magnitude and a duration of the impact, and wherein the threshold level of acceleration is expressed in terms of a head injury coefficient value. The head injury coefficient value is determined by empirically correlating a head injury coefficient measured at the body location and a head injury coefficient measured at the center of mass of a human head resulting from an impact.

These and other aspects of impact sensing device will be apparent after consideration of the Detailed Description and Figures herein. It is to be understood, however, that the scope of the invention shall be determined by the claims as issued and not by whether the given subject matter addresses any or all issues noted in the Background or includes any features or aspects recited in this Summary.

BRIEF DESCRIPTION OF THE DRAWINGS

Non-limiting and non-exhaustive embodiments of the impact sensing device, including the preferred embodiment, are described with reference to the following figures, wherein like reference numerals refer to like parts throughout the various views unless otherwise specified.

FIG. 18 is a parts list for the main board shown in FIGS. 14 and 15;

FIG. 19 is a parts list for the daughter board shown in FIGS. 16 and 17;

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

Figure 1:
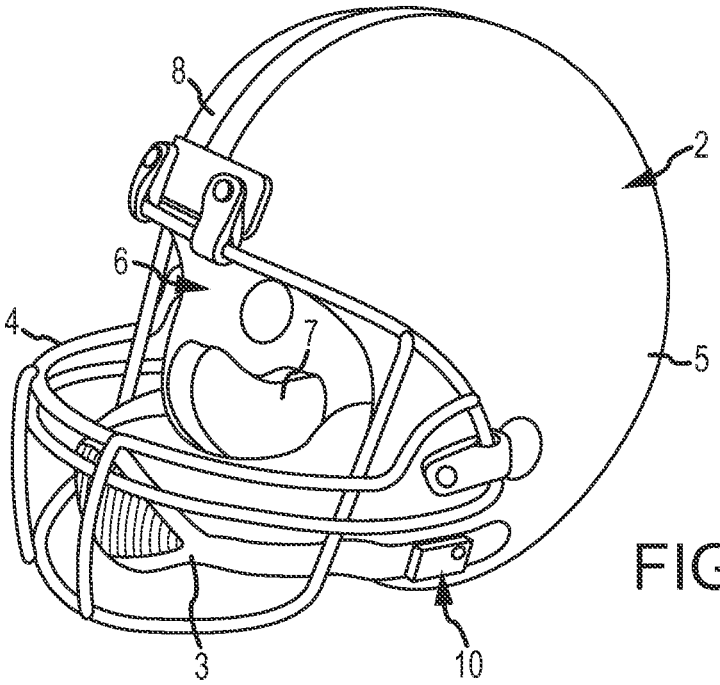
FIG. 1 is a perspective view of a helmet with a chin strap that incorporates an integrated impact sensing device according to a first exemplary embodiment.

FIG. 1 illustrates a football helmet 2 that includes a shell 5, padding 7, and a face guard 4. Attached to the exterior 8 of the helmet 2 is a chin strap 3 that includes an impact sensing device 10 according to a first exemplary embodiment.

While the exemplary embodiments described herein are directed to a football helmet, the helmet or head gear could be that used for any sport or purpose including for example and without limitation, hockey, wrestling, bicycling, skateboarding, baseball, skydiving, bull riding, motorcycling, auto racing, skiing, snowboarding, boxing, rugby, soccer, construction, etc. Furthermore, although the impact sensing device is shown in this embodiment as part of a chin strap, the impact sensing device 10 could be attached or adhered to the helmet alone or as part of another component of the helmet. For example, the impact sensing device 10 could be attached or adhered directly to the exterior 8 of shell 5. Impact sensing device 10 could be attached or adhered to the interior 6 of the shell 5. Also, the impact sensing device could be incorporated into another component, such as pad 7 or the like. It is also contemplated that the impact sensing device could be incorporated in other various items that attach to the body. For example and without limitation, a head-band, neck-band, sunglasses, glasses, goggles, safety glasses, facemasks, wrist-band, jewelry, and the like. Also, in military applications the impact sensing device could be attached to a helmet or body armor, for example.

Figure 2:
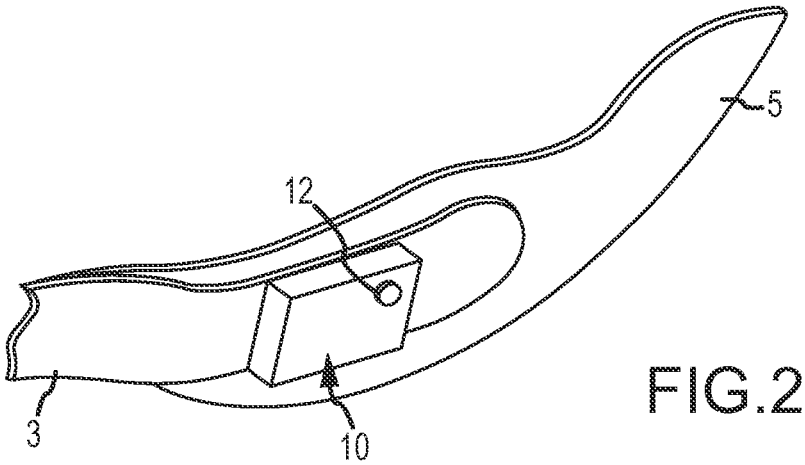
FIG. 2 is an enlarged partial perspective view showing the impact sensing device shown in FIG. 1.
Figure 3:
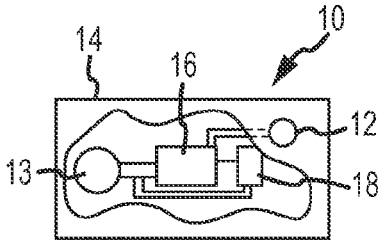
FIG. 3 is a cut away top plan view of the impact sensing device shown in FIGS. 1 and 2.

With further reference to FIG. 2, the impact sensing device includes an indicator 12 that is operative to indicate when the impact sensing device has sensed a selected threshold of acceleration that is, in this case, indicative of a potentially traumatic impact. Indicator 12 may be in the form of a visual indicator such as a light emitting diode (LED), or as another example an audible indicator, such as a piezoelectric buzzer. In either case the indicator has an active state and an inactive state. Referring now to FIG. 3, the impact sensing device 10 includes an accelerometer 18 that is capable of producing a signal (or signals) that is indicative of acceleration and/or the duration of acceleration. The impact sensing device 10 also includes an integrated circuit 16 that is operative to receive the signal from the accelerometer 18 and operative to cause the indicator 12 to be in the active state if the signal reaches a selected threshold level. The threshold could be a selected amount of g's and/or duration of the acceleration. The impact sensing device 10 also includes a power source in the form of a battery 13, such as a watch battery. The accelerometer 18 may be a single axis or multi axis accelerometer or multiple accelerometers. The interconnection of the components may be accomplished with appropriate wiring, circuitry, and/or a printed circuit board as is know to those skilled in the art. In an embodiment, the impact sensing device includes a plurality of accelerometers oriented orthogonally to each other for sensing acceleration in three axes, as is known in the art. Furthermore, the derivation of the resultant magnitude and direction of an impact based on signals from multiple accelerometers is well understood and may be readily implemented by those of ordinary skill in the art.

In this embodiment, the impact sensing device 10 is encapsulated in a polycarbonate material 14. The indicator 12 may protrude from the polycarbonate such that it is visible or audible. Alternatively, the indicator 12 may be encased with the other components in a clear or translucent material. The polycarbonate material may also include additives, such as an impact additive.

Figure 4:
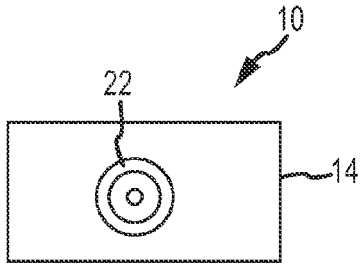
FIG. 4 is a bottom plan view of the impact sensing device shown in FIGS. 1-3.
Figure 5:
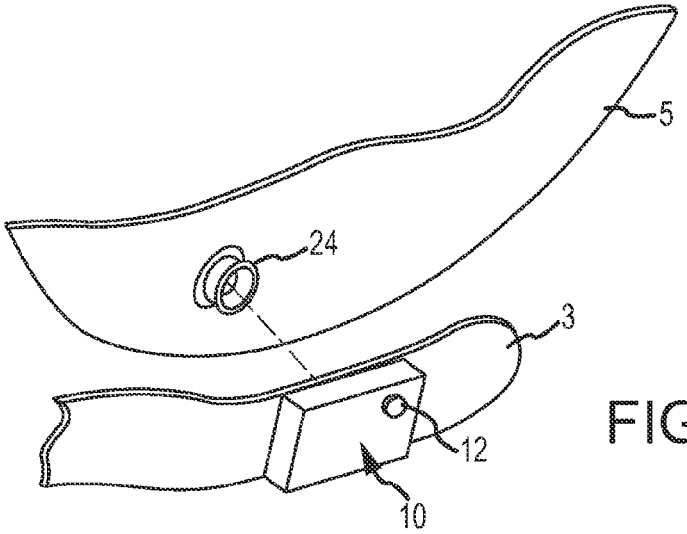
FIG. 5 is an enlarged partial perspective view of the impact sensing device shown disengaged from the helmet.

Referring to FIGS. 4 and 5, the impact sensing device 10, in this case, includes a button snap 22 (female portion) that may be attached to a cooperating button snap 24 (male portion) that is secured to the helmet shell 5. In this case the button snap is also used to attach one end of the chin strap. The button snap 22 is incorporated into the circuitry of the device 10 such that the device is inactive when disengaged from the mating snap portion 24. Once the impact sensing device 10 is snapped to the helmet (along with the chin strap 3) the device 10 is activated. This may be accomplished by completing a circuit with the mating snap. Alternatively, the snap 24 depresses a momentary switch located in snap 22. In either case the impact sensing device is inactive when disengaged from the snap 24 and active when engaged with the snap 24. By attaching the impact sensing device 10 to the chin strap 3 the device is retained on the helmet 2 to help prevent it from becoming lost when the device is disengaged. While the exemplary embodiments show the impact sensing device 10 as part of the chin strap 3, the impact sensing device may be separately attached to a helmet or other object in the same manner.

Impact sensing device 10 may also be activated with a conventional on-off switch as is known in the art. It is further contemplated that the impact sensing device could be activated by a pressure or compression switch. Furthermore, the impact sensing device could be activated by movement or by solar exposure, as additional examples.

In operation the impact sensing device 10 is engaged with the snap 24 thereby activating the device. Once the accelerometer 18 senses an acceleration and the integrated circuit 16 determines that the acceleration and/or duration exceeded a selected threshold, the integrated circuit turns on indicator 12 for a predetermined period of time whereby an observer is alerted that the user of the helmet may have sustained a concussion. After a predetermined period of time the indicator 12 is turned off and the impact sensing device is reset. To that end the integrated circuit 16 may include a timer or a separate timer chip may be employed. Indicator 12 may be a multi-color LED that is capable of displaying different colors. Accordingly, the integrated circuit could be programmed to display different colors for different levels of acceleration and/or duration.

Figure 6:
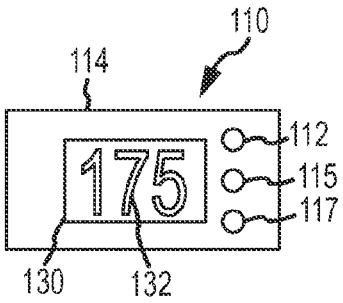
FIG. 6 is an impact sensing device according to a second exemplary embodiment.

FIG. 6 illustrates an impact sensing device 110 according to a second exemplary embodiment. In this embodiment, the impact sensing device 110 is similar to the first embodiment described above except that it includes multiple indicators 112, 115, 117, and/or 130. Indicators 112, 115, and 117 are visual indicators such as LEDs. In this case each indicator could be used for a different axis of the accelerometer where a multi-axis accelerometer is employed. Alternatively, the indicators could be used to signal different levels or durations of acceleration. Also, as mentioned above multi-color LEDs could be used in combination to indicate many levels of acceleration. For example, levels of acceleration of interest range from 50 g to 200 g. Indicator 130 is in the form of a liquid crystal display (LCD). Indicator 130 could be used alone or in conjunction with indicators 112, 115, and 117. Indicator 130 is operative to display a number 132 that indicates the actual level of acceleration in g's that is sustained by the impact sensing device. In addition, indicator 130 could display the duration of the acceleration and toggle between g's and duration. Thus, the indicators 112, 115, and 117 could indicate to an observer from afar that the user has sustained a potentially harmful impact and indicator 130 can communicate the exact level of impact in terms of g's and duration.

Figure 7:
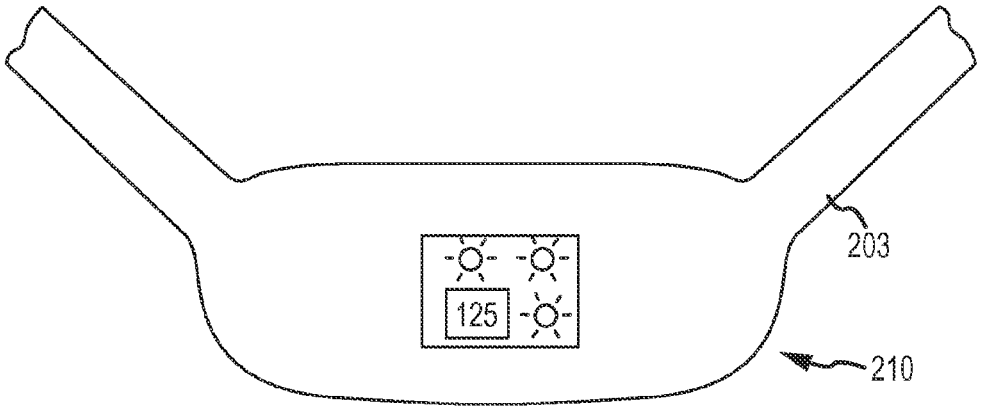
FIG. 7 is an impact sensing device according to a third exemplary embodiment.
Figure 8:
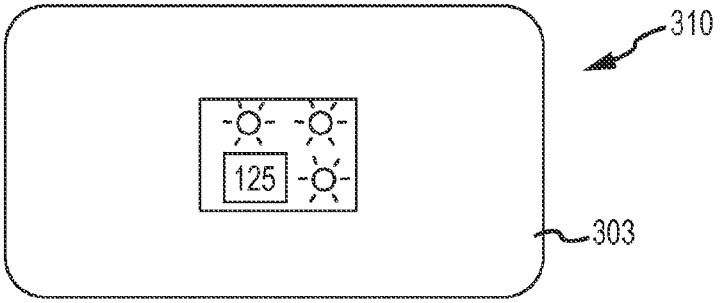
FIG. 8 is an impact sensing device according to a fourth exemplary embodiment.

FIG. 7 illustrates an impact sensing device 210 according to a third exemplary embodiment. In this case, the impact sensing device 210 is similar to the second exemplary embodiment described above with respect to FIG. 6; however, impact sensing device 210 is incorporated with a chin strap 203. FIG. 8 illustrates an impact sensing device 310 according to a fourth exemplary embodiment. In this embodiment, the impact sensing device 310 is incorporated with a sleeve 303 that may be used in conjunction with a helmet strap, such as a chin strap.

It is also contemplated that the impact sensing device described herein may include circuitry for communicating the g's and duration of an impact to a recording or display device. The impact sensing device may include circuitry and logic as is known in the art, such as Bluetooth, for wirelessly communicating to a recording device/display device. Accordingly, the impact sensing device may connect to the internet (or cloud) directly or via the recording/display device. It is also contemplated that the recording/display device could receive communications from multiple impact sensing devices from each player of a football team, for instance. Thus, a coach on the sideline could monitor the condition of each player in real time.

Figure 9:
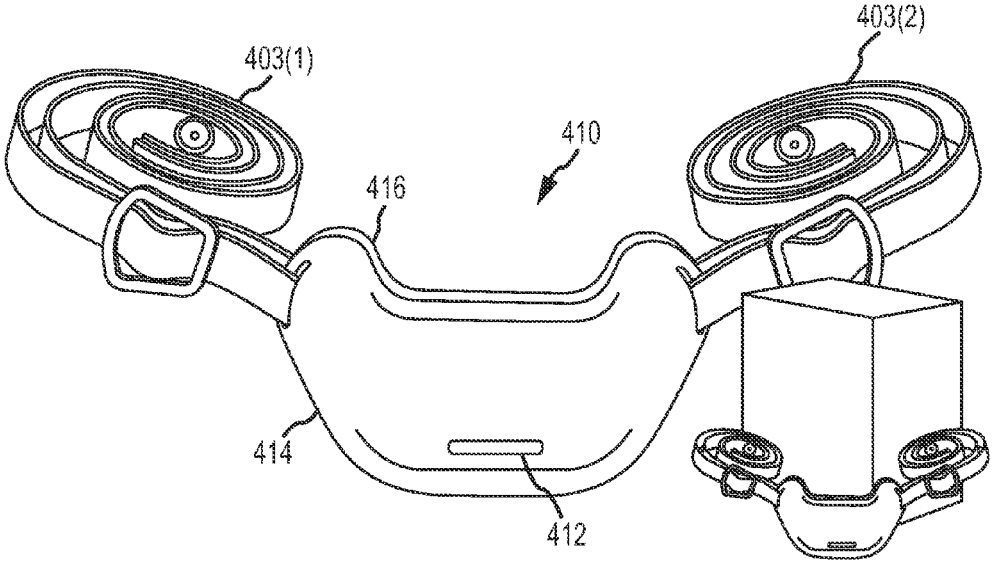
FIG. 9 is an impact sensing device according to a fifth exemplary embodiment in the form of a helmet chin strap.
Figure 10:
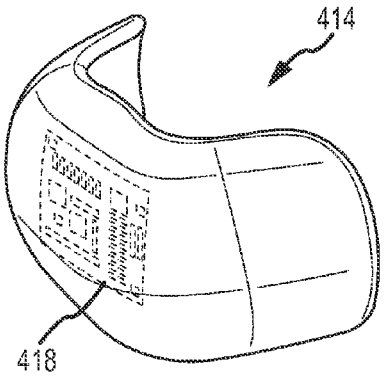
FIG. 10 is a partially transparent perspective view of the chin strap shown in FIG. 9 illustrating the placement of circuit boards therein.

FIG. 9 illustrates an impact sensing device, according to a fifth exemplary embodiment, in the form of a chin strap. Impact sensing device 410 includes an outer protective chin guard shell 414 with a soft inner cuff 416. With further reference to FIG. 10, outer shell 414 includes at least one circuit board 418 disposed therein, which supports an accelerometer and circuitry for sensing the magnitude and direction of impacts to a wearer's head. Circuit board 418 includes an indicator 412 in the form of a multi-color LED. LED 412 is a three-color indicator: green, yellow, and red (other colors may be used) Inner cuff 416 may be removed from shell 414 for cleaning Also, inner cuff 416 is removable to allow access to an on/off switch (not shown) that is associated with circuit board 418. Impact sensing device 410 also includes a pair of straps 403(1) and 403(2) which may be attached to a helmet such as a football helmet.

FIGS. 13A-13E are schematic diagrams illustrating the impact sensing device's circuitry according to an exemplary embodiment. Corresponding exemplary circuit board layouts are shown in FIGS. 14-17 and associated parts lists are shown in FIGS. 18 and 19. In this case, the impact sensing device includes a main (or mother) board (See FIGS. 13A-13D, 14, 15) including the micro-controller U5, accelerometers A1 and A2, and indicator LED1. A separate daughter board (See FIGS. 13E, 16, 17) includes a third accelerometer U1. While the schematics, circuit boards, and parts lists shown in FIGS. 13A-19 illustrate a particular embodiment, other board layouts and components may be selected.

Figure 11A:
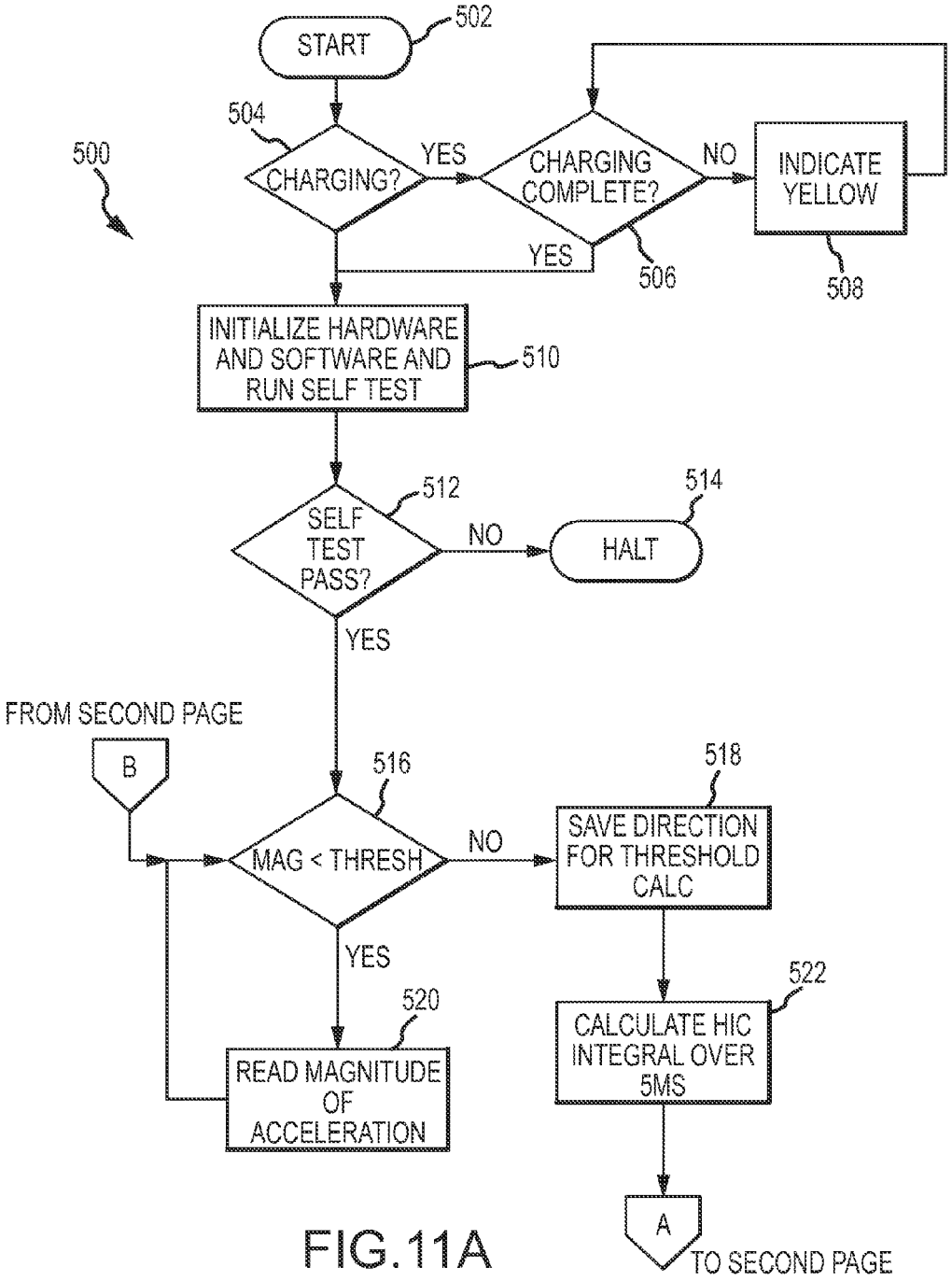
FIGS. 11A and 11B is a representative flow diagram illustrating steps in the operation of the impact sensing device.
Figure 11B:
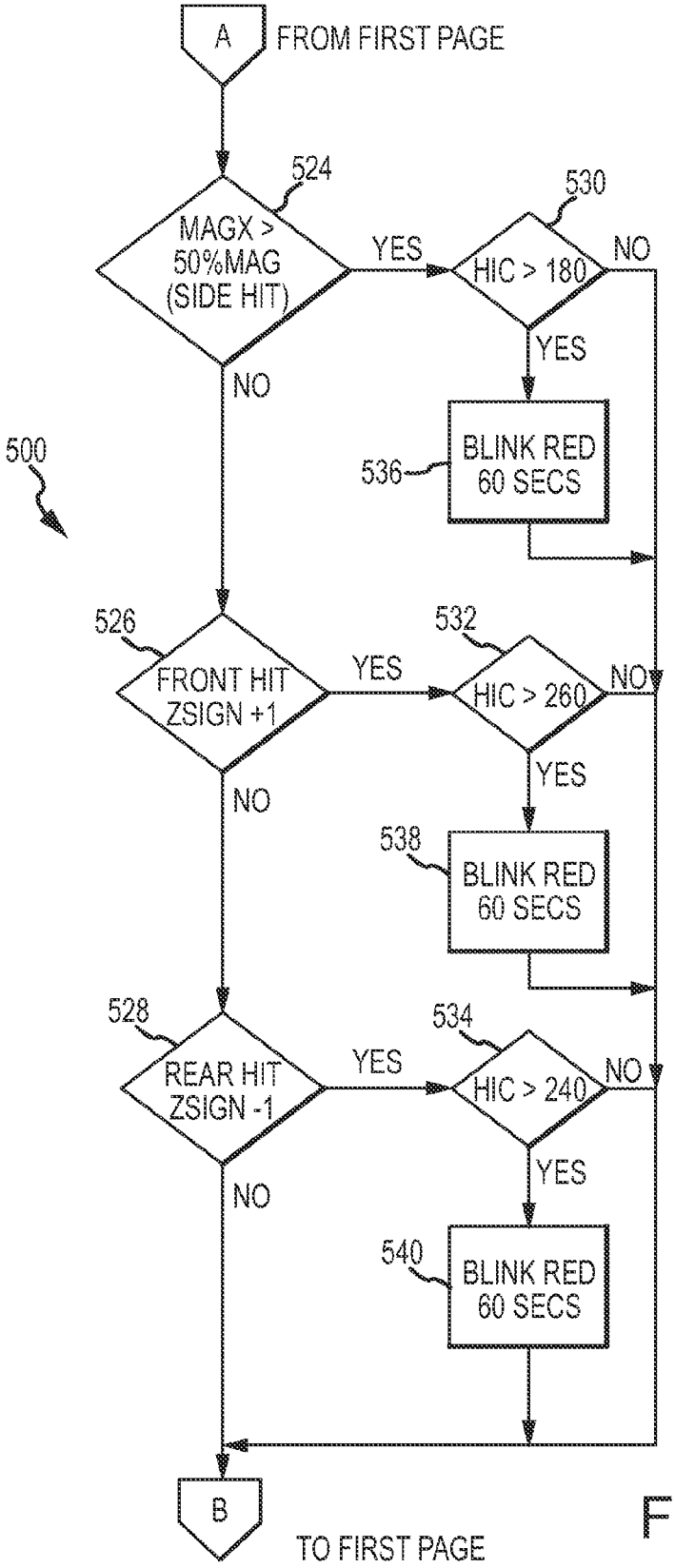

FIGS. 11A and 11B illustrate a flow diagram 500 of the various processes within the impact sensing device. Beginning with FIG. 11A, the process begins at 502 and flows to step 504 where it is determined whether the impact sensing device is charging. If the device is charging a determination is made as to whether the charging is complete. If the charging is not complete, the indicator LED is illuminated in yellow at 508. If charging is complete, the process continues on to initialize the hardware and software and run a self test routine at step 510. If the self test does not pass at 512, the system is halted at 514. If the system passes at 512, then the impact sensing device is active and continuously monitors magnitude of acceleration at 516. As long as the magnitude of acceleration (Mag) is less than the threshold (Thresh) at 516, the system will continuously read magnitude of acceleration at 520. Once the magnitude has exceeded the threshold the process flows to 518 where the direction from the impact was received by the impact device is recorded. Next, the head injury coefficient (HIC) is calculated over an integral of five milliseconds (5 ms) at step 522.

The HIC score was developed for predicting the probability of a concussion due to an impulse impact applied to the skull in terms of acceleration of the center of mass of the head. The actual HIC score depends on the average acceleration over the duration of the impulse and is given by:

$$HIC \equiv (t_2 - t_1)\left[\frac{1}{t_2 - t_1}\int_{t_1}^{t_2} a(t)dt\right]^{\frac{5}{2}}$$

Where the average acceleration is, $\bar{a}$is:

$$\bar{a} = \frac{1}{t_2 - t_1}\int_{t_1}^{t_2} a(t)dt$$

HIC score ranges have been established that indicate the expected severity of trauma and degree of concussion associated with a particular impact. These ranges and associated injuries are shown below in Table 1.

TABLE 1

| Head Injury Criteria | (M)AIS—Code | Injury | Concussion Likelihood |
|---|---|---|---|
| >135 | 0 | Not Injured | No Concussion |
| 135-519 | 1 | Minor | Mild Concussion |
| 520-899 | 2 | Moderate | Severe Concussion |
| 900-1254 | 3 | Serious | Severe Concussion |
| 1255-1574 | 4 | Severe | Severe Concussion |
| 1575-1859 | 5 | Critical | Life Threatening Coma |
| >1859 | 6 | Maximum (high lethality) | Life Threatening Coma |

Figure 20:
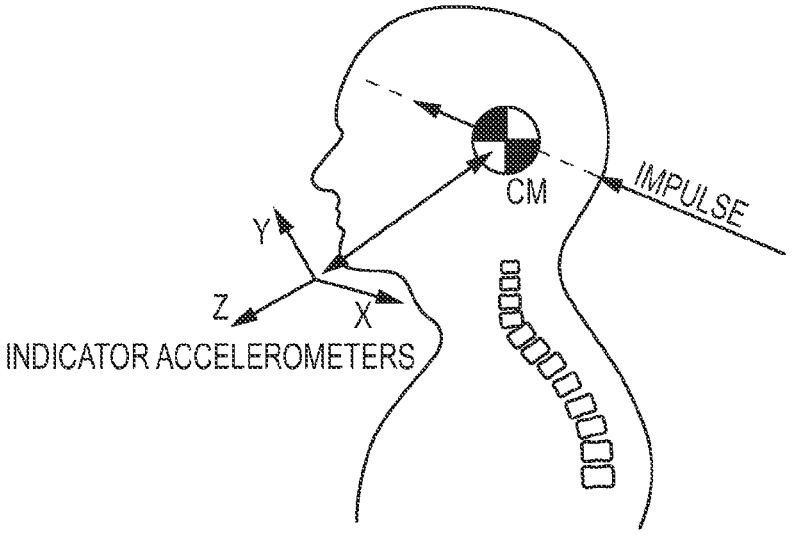
FIG. 20 is a schematic representation of the relative location of an impact sensing device to the center of mass of a human head.

Continuing to FIG. 11B, based on the magnitude and direction of the impact, the indicator threshold is adjusted to indicate the possibility of injury at an equivalent HIC score of 240. Because the impacts from different directions are different distances from the center of mass of the wearer's head (see FIG. 20), the head injury threshold must be adjusted based on the direction. Adjustments to the HIC score thresholds are determined based on empirical testing so that the indicator is activated at the desired equivalent HIC score. For example, if it is determined at 524 that the impact was from the side, a HIC score greater than the side impact threshold of 180 at step 530 will result in the indicator being activated at 536. When activated the LED blinks red for approximately 60 seconds. If the impact is from the front, the HIC score must be greater than the front impact threshold of 260 in order to cause indicator to blink red (see 526, 532, 538). And finally, if the impact is from the rear, the indicator will activate if the HIC score exceeds the rear impact threshold of 240 (see 528, 534, 540) Accordingly, as summarized in Table 2, the HIC scores from each direction are all set to be equivalent to a HIC score 240 at the center of mass of the user's head.

TABLE 2

| | Head CM HIC | Indicator Equivalent HIC |
|---|---|---|
| Rear | 240 | 240 |
| Front | 240 | 250 |
| Side | 240 | 180 |

Figure 21:
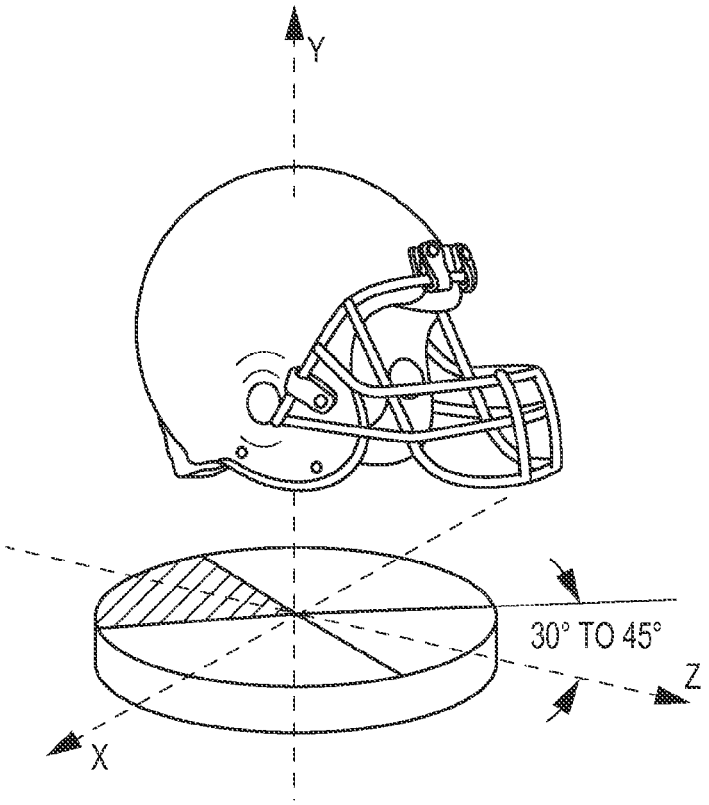
FIG. 21 is a schematic diagram of representative impact zones.

As shown in FIG. 21, the left and right impact zones are symmetric. An impact between 0 and 30 degrees will register as hits from the front and hits between 45 degrees and 135 degrees will register as side hits. Between roughly 30 degrees and 45 degrees there is a transition region where hits can register as either from the front or the side.

While the threshold levels, equivalent HIC score, and impact zones are specifically defined above with respect to the exemplary embodiment, these variables may be adjusted depending on many factors as necessary. For example, the thresholds may be adjusted depending on the type of helmet. Furthermore, the threshold and equivalent HIC score may be changed based on the wearer's variables, such as for example, age, weight, height, etc. The HIC score may be adjusted to provide more or less of a safety factor or to reduce false tripping, as examples.

Figure 12:
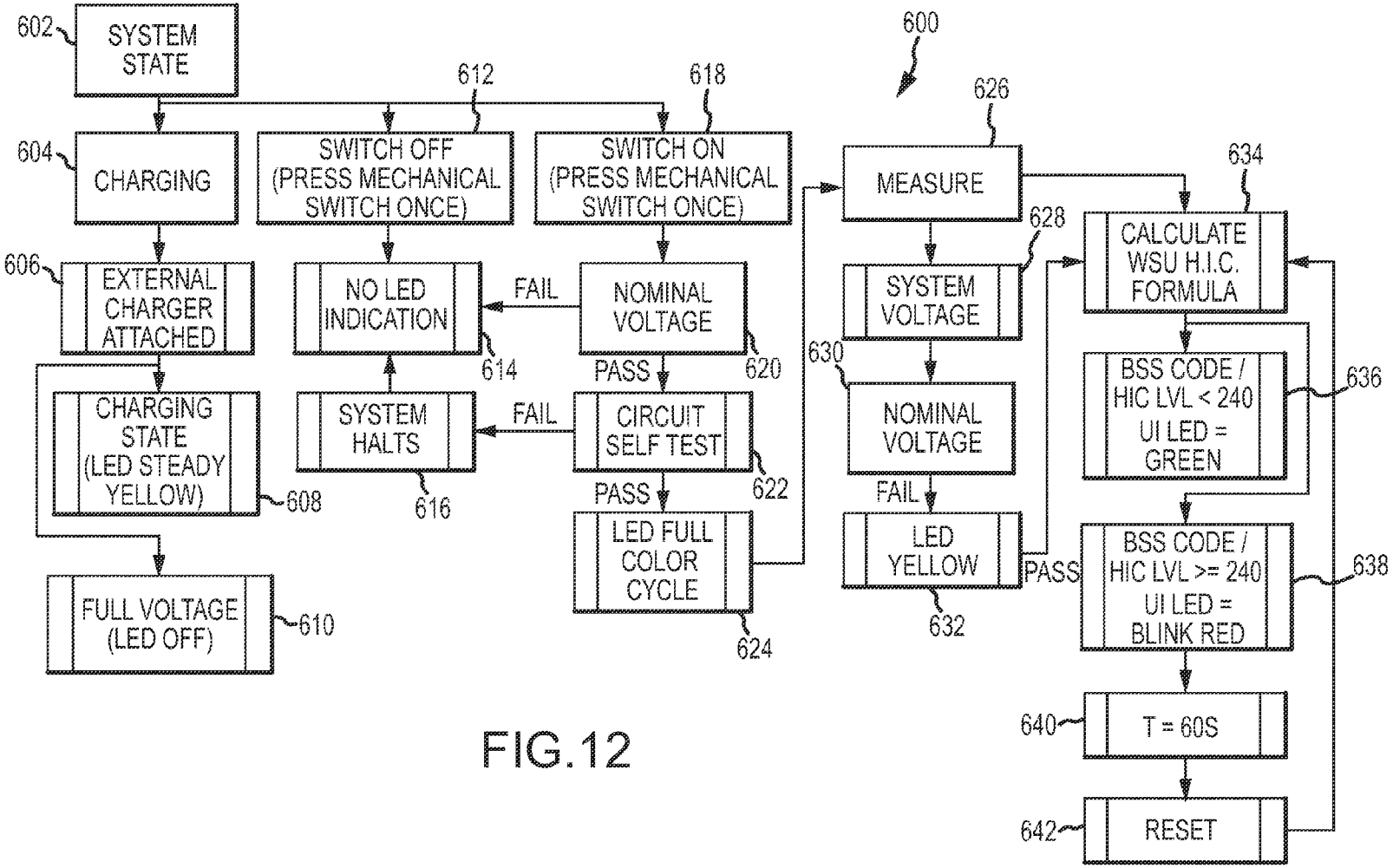
FIG. 12 is an LED indicator system state diagram.
Figure 13A:
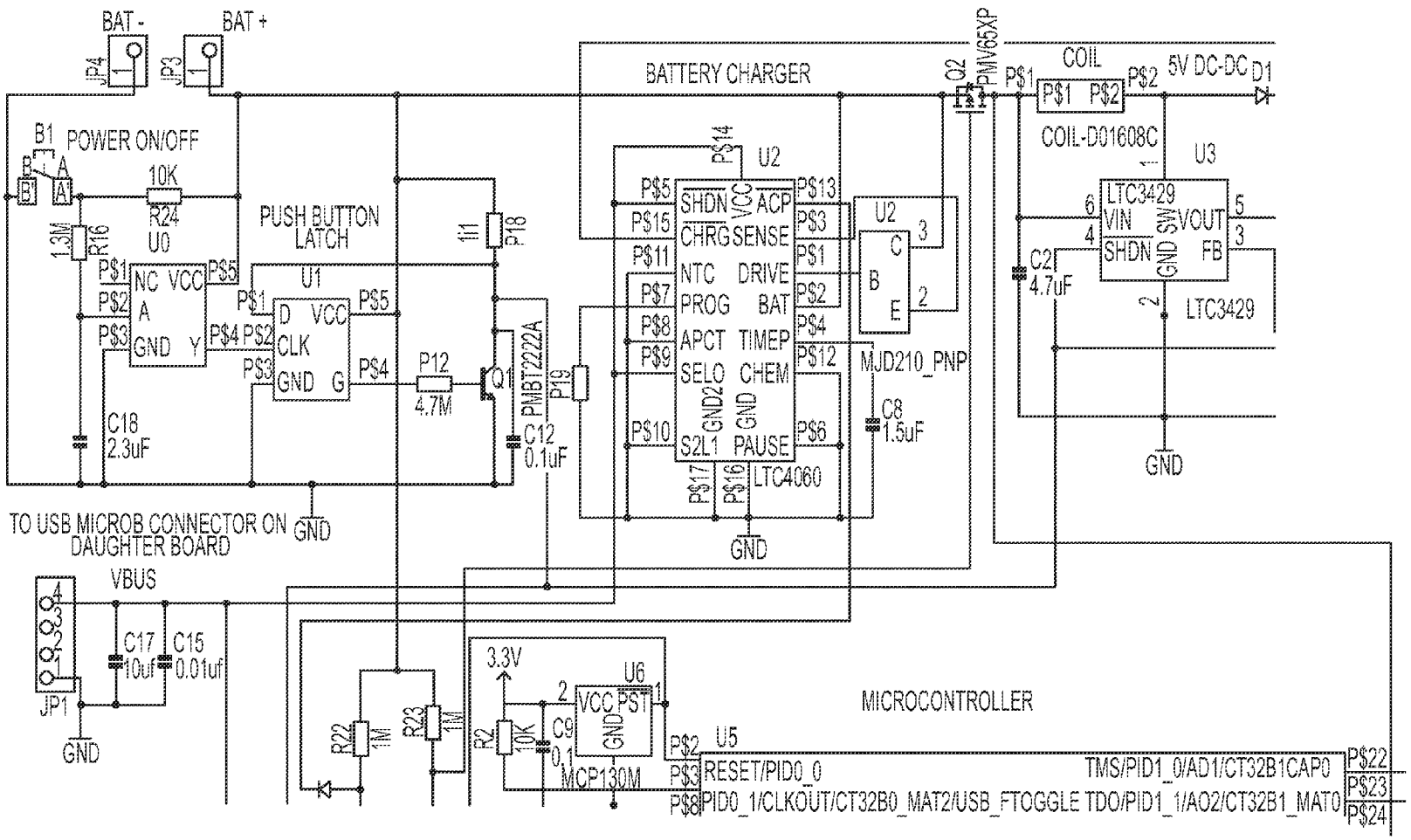
FIGS. 13A-13E are schematic diagrams illustrating the impact sensing device's circuitry according to an exemplary embodiment.
Figure 13B:
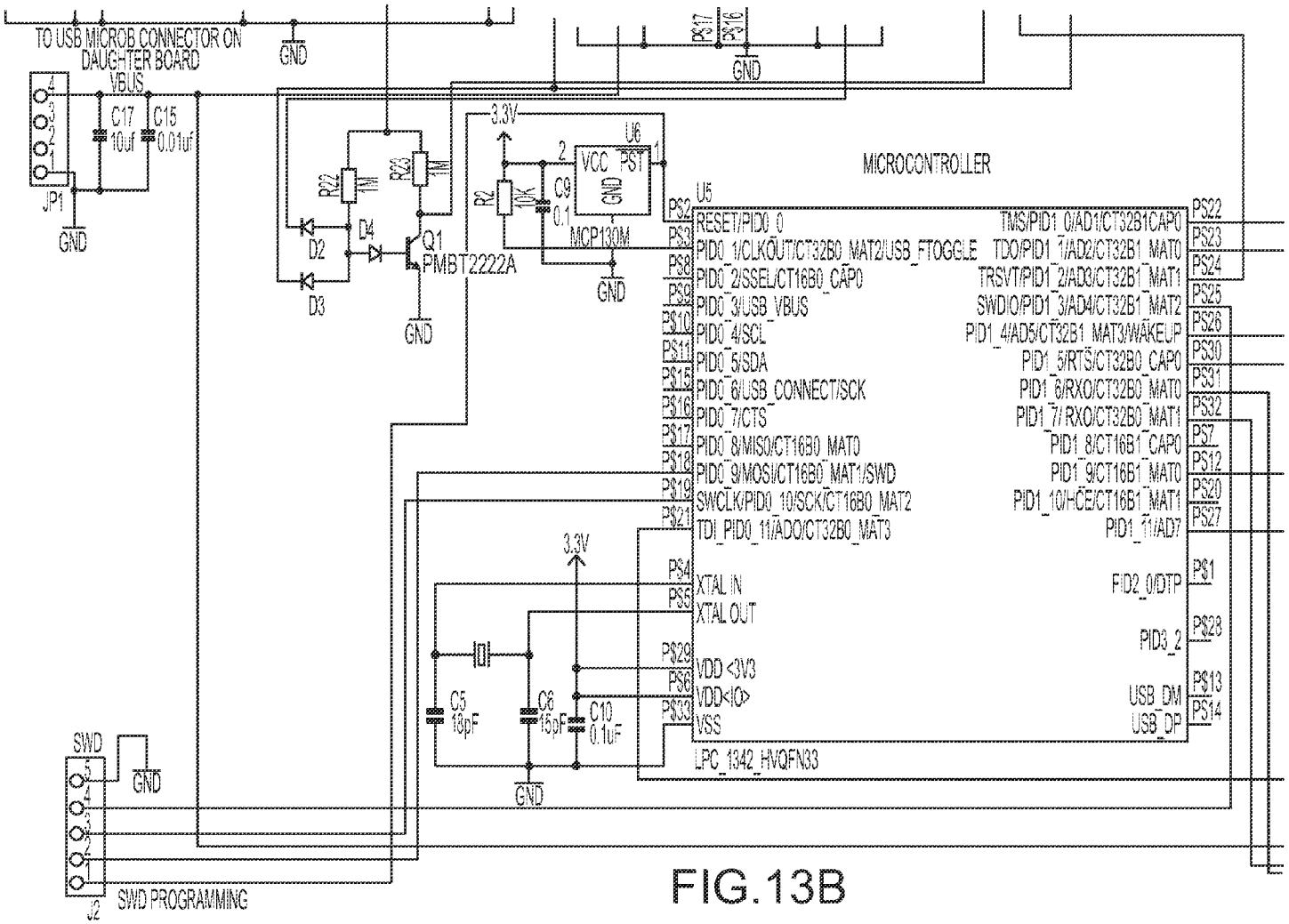
Figure 13C:
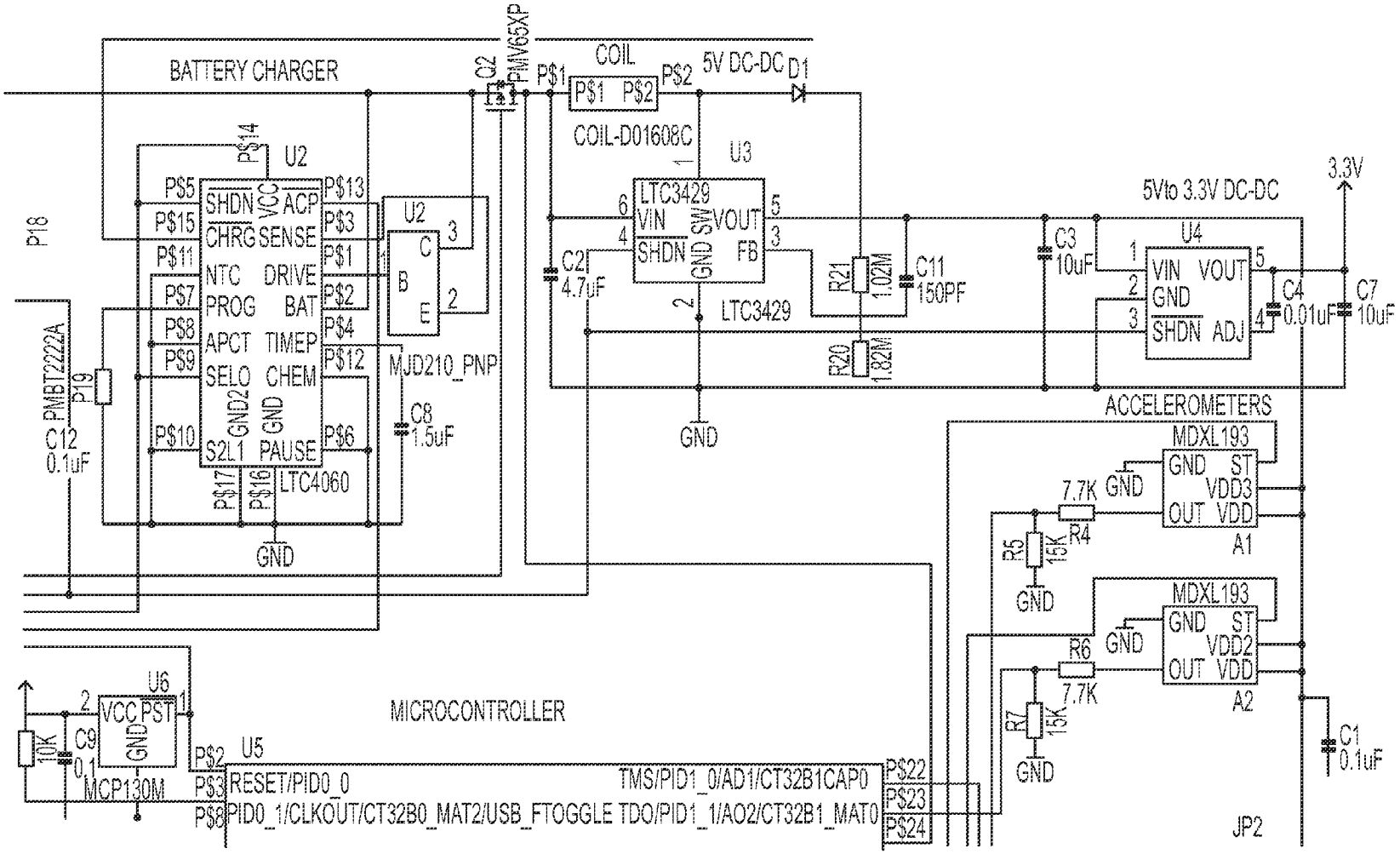
Figure 13D:
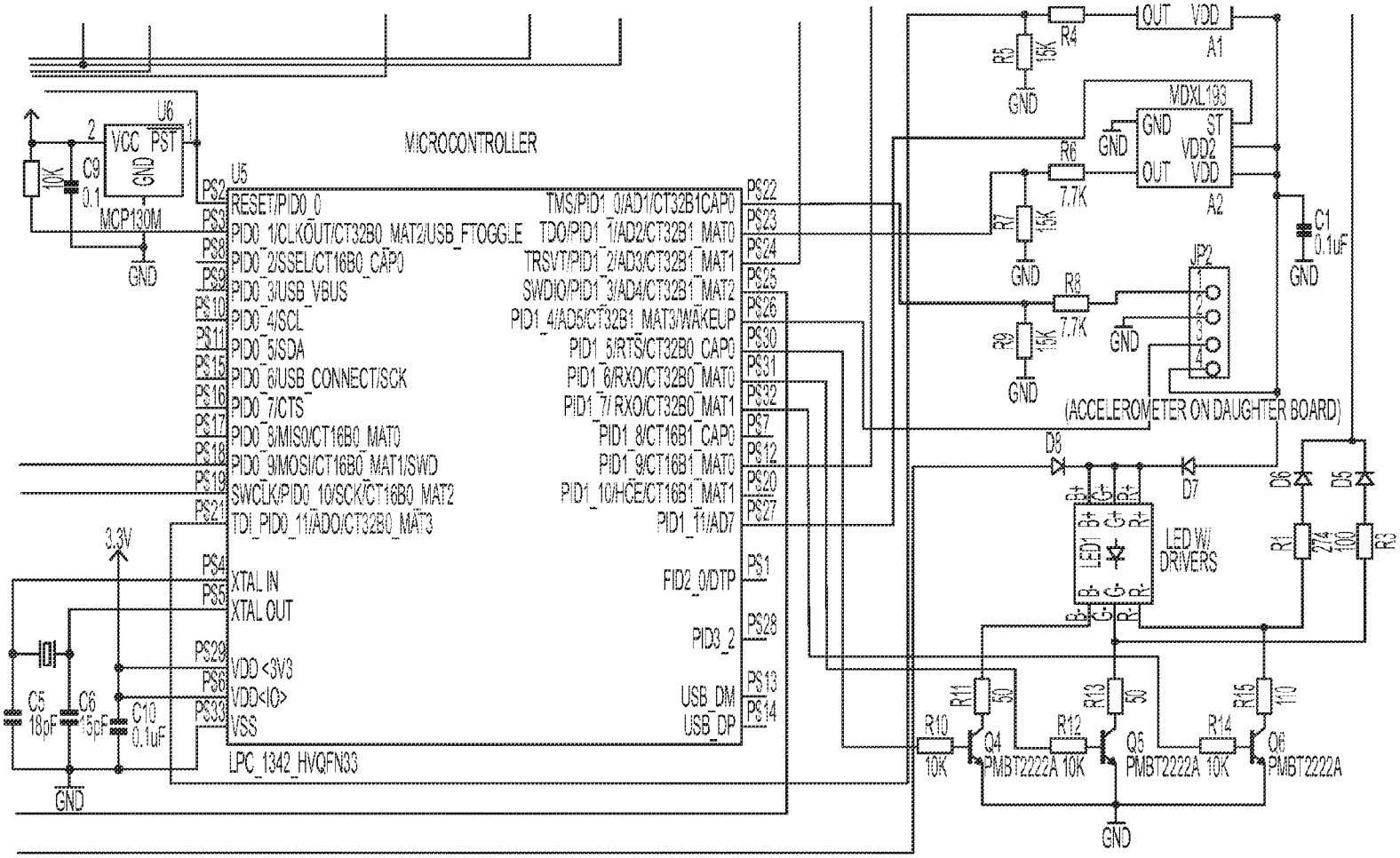
Figure 13E:
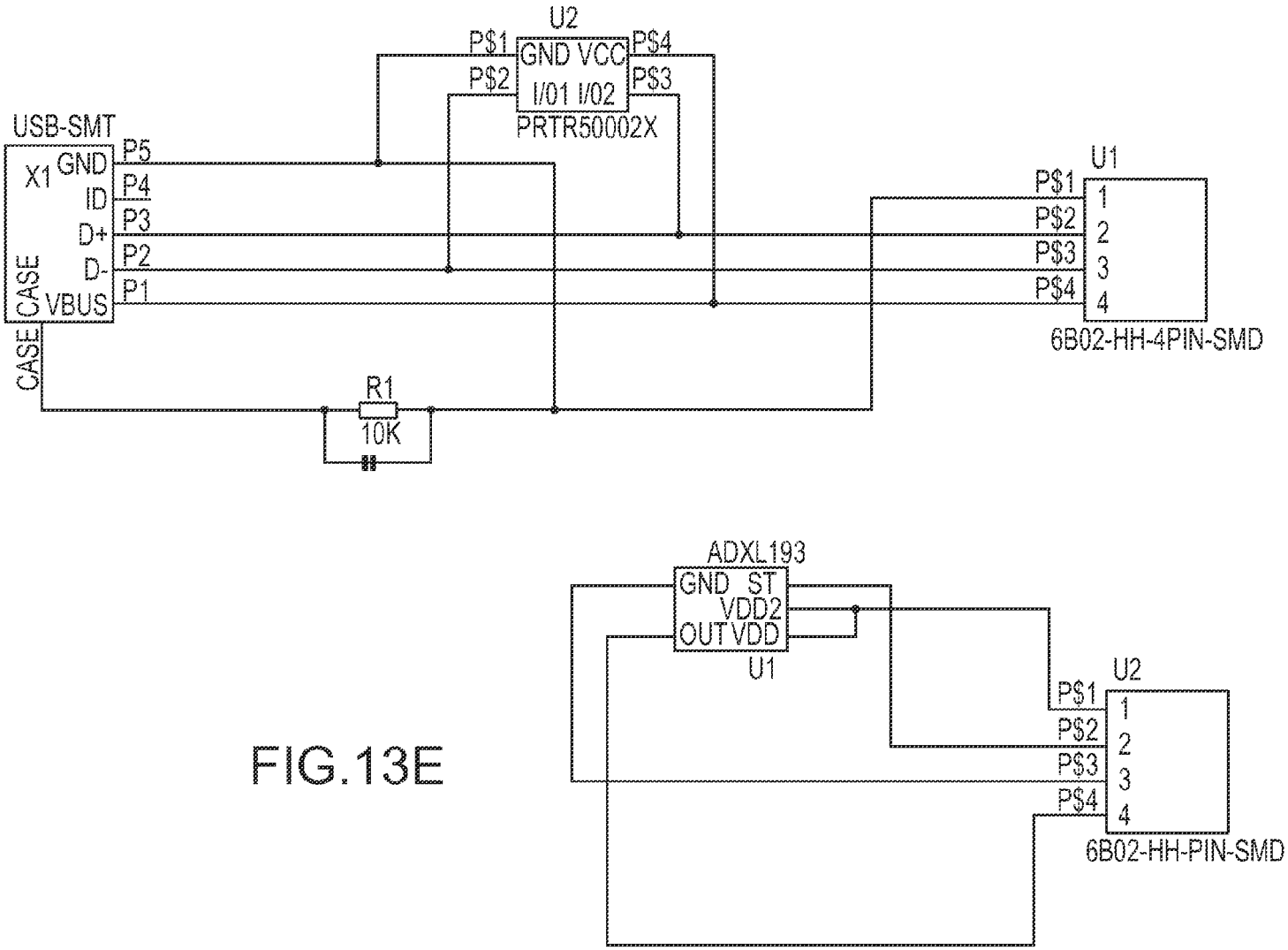
Figure 14:
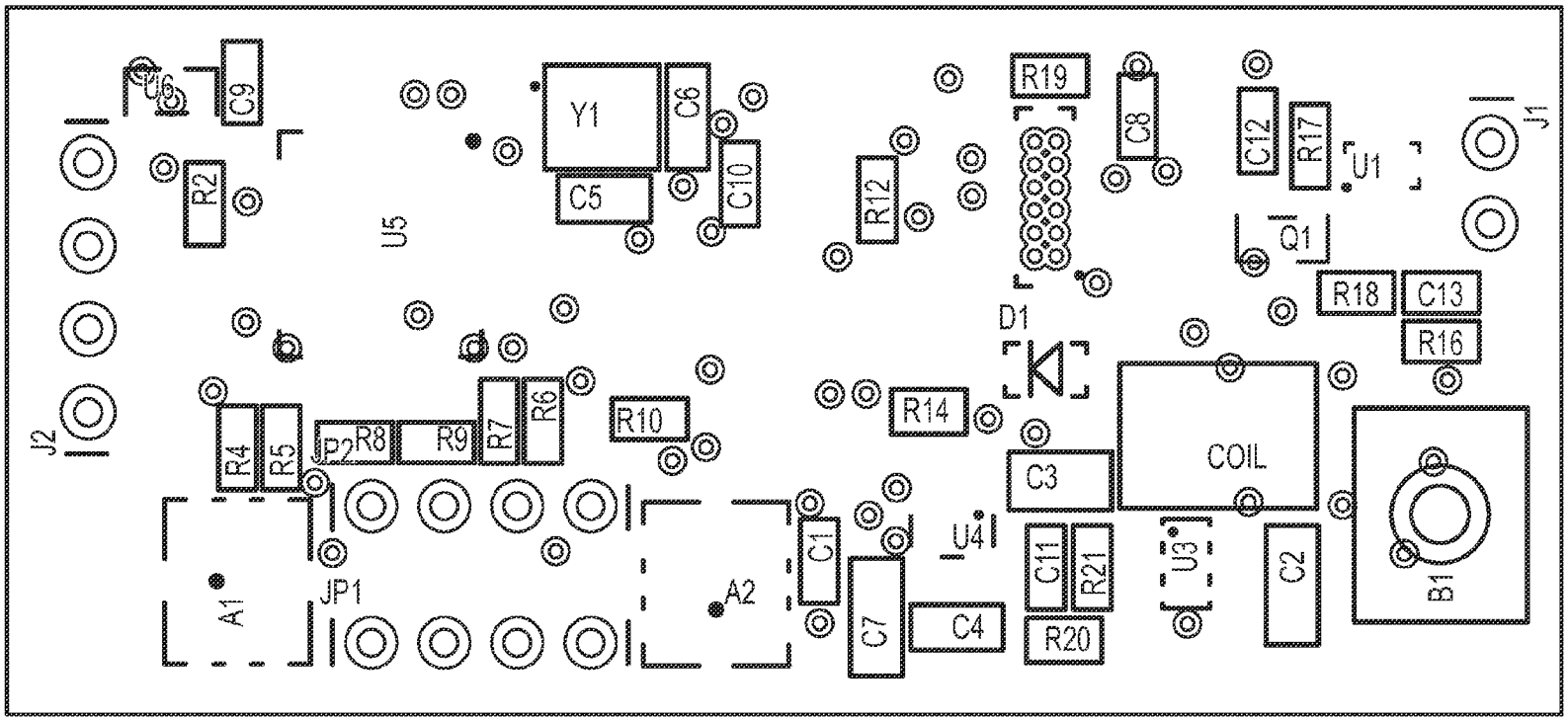
FIG. 14 is a top plan view of the main board of the impact sensing device according to an exemplary embodiment.
Figure 15:
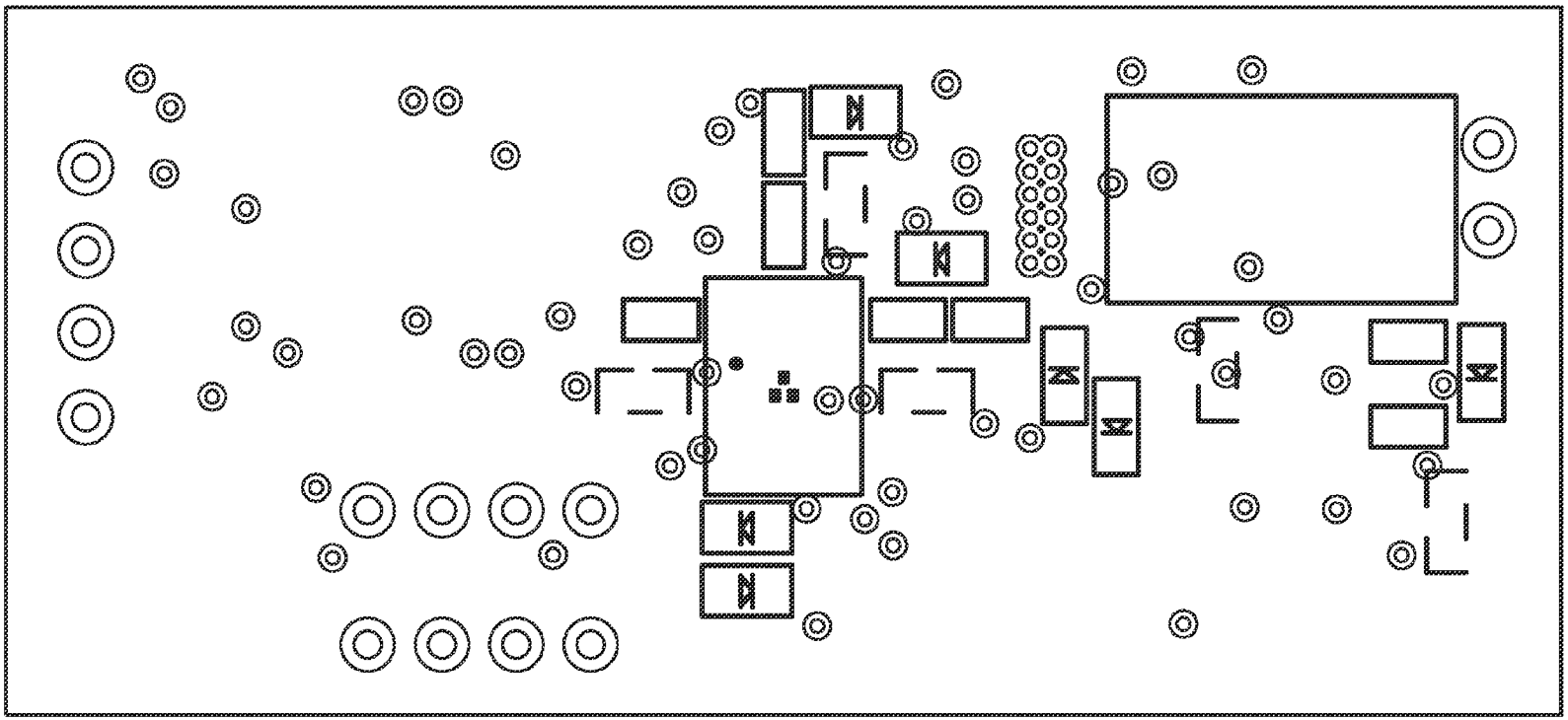
FIG. 15 is a bottom plan view of the main board shown in FIG. 14.
Figure 16:
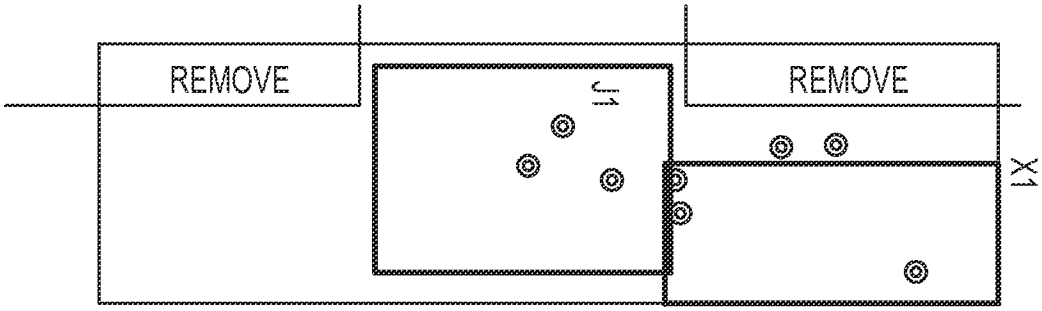
FIG. 16 is a top plan view of the daughter board of the impact sensing device according to an exemplary embodiment.
Figure 17:
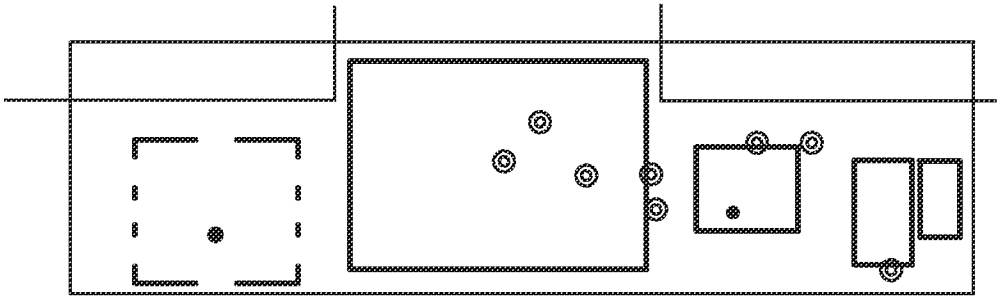
FIG. 17 is a bottom plan view of the daughter board shown in FIG. 16.

Referring now to FIG. 12, the LED indicator state diagram 600 is discussed. System state 602 may be either charging 604, switched off 612, or switched on 618. When the impact protection device is charging at 604, the external charger is attached at 606 and a charging state indication at 608 indicates a steady yellow light. Once the device reaches a full charge, the LED is turned off at 610 indicating that the device is fully charged. When the device is switched off at 612, there is no LED indication indicated at 614 and the system is halted at 616. When the device is switched on at 618, the system is checked for nominal voltage at 620, and if the nominal voltage test passes, it continues to a circuit self test 622. If the circuit self test 622 passes, the LED full color cycle is executed at 624 wherein the LED is cycled through red, yellow, and green colors. At this point, the device is active and ready to measure and indicate possible head injury levels requiring attention. At 626, the device measures impacts and continuously monitors the system voltage at 628, wherein if the system voltage is less than nominal, the yellow indicator is illuminated at 632. As long as the nominal voltage remains constant at 630, the device calculates the head injury coefficient formula based on the input from the accelerometers at 634. At 636, if the equivalent HIC level is less than 240, the LED indicator is illuminated green at 636. If the equivalent HIC level is greater than or equal to 240, the indicator blinks red for 60 seconds and then resets at 642.

Also, contemplated are methods for indicating when a user has received a potentially traumatic impact to the head according to the present disclosure. The methods thus encompass the steps inherent in the above described structures and operation thereof. Broadly, one method could include providing an impact sensing device as described above, establishing at least one threshold level of acceleration, receiving a magnitude of acceleration from the impact sensing device, and indicating if the magnitude exceeds the threshold of acceleration.

Methods for establishing threshold levels of acceleration to be used in conjunction with an impact sensing device are also contemplated. For example, such a method could include correlating acceleration measured at the chin and acceleration measured at the center of mass of a human head resulting from an impact. The correlation may be expressed in terms of HIC score as explained above. Moreover, a correlation could be established for various zones of impact to a users head, such as those discussed above with respect to FIG. 21. In an embodiment, the correlation may be established by attaching an impact sensing device to a headform. In this case, the head form is a human analog incorporating an accelerometer located at its center of mass. Such human analog head forms are well known in the art. The impact sensing device may be in the form of a chin strap attached to a football helmet, for example. The correlation is established by impacting the head form with a suitable impactor and recording the difference in acceleration measured by the impact sensing device and the head form. A suitable impactor is available from Biokinetics of Ottowa, Ontario, Canada. The procedure may be repeated to establish an average difference in acceleration measurements between the impact sensing device and center of mass. Furthermore, the procedure may be repeated from different directions relative to the head form to establish correlations for various impact zones. The correlation data may be stored in the impact sensing device as thresholds for activating the impact indicator. While the above methods are described with respect to an impact sensing device in the form of a chin strap other types of items securable to a person may be used in the same manner.

Accordingly, the impact sensing device and associated methods have been described with some degree of particularity directed to the exemplary embodiments. It should be appreciated, though, that the technology of the present application is defined by the following claims construed in light of the prior art so that modifications or changes may be made to the exemplary embodiments without departing from the inventive concepts contained herein.

What is claimed is:

1. An impact sensing device, comprising:

a plurality of accelerometers;

an indicator;

an integrated circuit; and a chin guard sized and configured to receive a person's chin, wherein the accelerometers and integrated circuit are contained in the chin guard; each accelerometer orthogonally oriented with respect to each other and each capable of producing a signal indicative of an impact; the integrated circuit configured to receive signals from the accelerometers and determine a magnitude and direction of an impact and activate the indicator when the magnitude exceeds a selected threshold based on the direction of the impact.

2. The impact sensing device of claim 1, wherein the indicator is a visual indicator.

3. The impact sensing device of claim 1, further comprising a soft inner cuff disposed in the chin guard.

4. The impact sensing device of claim 1, further comprising a strap connectable to a helmet.

5. The impact sensing device of claim 4, further comprising a button snap attached to the strap and connectable to a helmet, wherein the button snap includes contacts operative to activate the impact sensing device when connected to the helmet.

6. An impact sensing chin guard, comprising:

a plurality of accelerometers orthogonally oriented with respect to each other and each capable of producing a signal indicative of an impact;

a visual indicator;

an integrated circuit configured to receive the signals and determine a magnitude and direction of the impact and activate the indicator when the magnitude exceeds a selected threshold based on the direction of the impact;

a chin guard shell sized and configured to receive a person's chin; and an inner cuff disposed in the chin guard shell, wherein the accelerometers and integrated circuit are contained within the chin guard, interposed between the chin guard shell and the cuff.

7. The impact sensing chin guard of claim 6, further comprising a strap connectable to a helmet.

8. The impact sensing chin guard of claim 6, wherein the visual indicator is a multicolor light emitting diode.

9. A method for indicating when a user has received a potentially traumatic impact, the method comprising:

establishing a threshold level of acceleration for at least one direction of interest;

attaching a chin guard to a chin of the user, wherein a plurality of accelerometers and an integrated circuit are contained in the chin guard; each accelerometer orthogonally oriented with respect to each other and each capable of producing a signal indicative of an impact; the integrated circuit configured to receive signals from the accelerometer and determine a magnitude and direction of an impact and activate an indicator when the magnitude exceeds a selected threshold based on the direction of the impact;

determining the magnitude and direction of the impact based on the signals; and activating an indicator if the magnitude exceeds the threshold level of acceleration.

10. The method according to claim 9, including establishing a first threshold level of acceleration for a first direction and a second threshold of acceleration for a second direction.

11. The method according to claim 10, wherein the first threshold level is greater than the second threshold level.

12. The method according to claim 11, wherein the first direction corresponds to the front of the user's head.

13. The method according to claim 12, wherein the second direction corresponds to a side of the user's head.

14. The method according to claim 9, including determining a head injury coefficient based on the magnitude and a duration of the impact, and wherein the threshold level of acceleration is expressed in terms of a head injury coefficient value.

15. The method according to claim 14, wherein the head injury coefficient value is determined by empirically correlating a head injury coefficient measured at the body location and a head injury coefficient measured at the center of mass of a human head resulting from an impact.

* * * * *